US009858939B2

(12) United States Patent
Grancharov et al.

(10) Patent No.: US 9,858,939 B2
(45) Date of Patent: Jan. 2, 2018

(54) METHODS AND APPARATUS FOR POST-FILTERING MDCT DOMAIN AUDIO COEFFICIENTS IN A DECODER

(75) Inventors: Volodya Grancharov, Solna (SE); Sigurdur Sverrisson, Kungsangen (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 1077 days.

(21) Appl. No.: 13/104,565

(22) Filed: May 10, 2011

(65) Prior Publication Data

US 2011/0282656 A1 Nov. 17, 2011

Related U.S. Application Data

(60) Provisional application No. 61/333,498, filed on May 11, 2010.

(51) Int. Cl.
*G10L 19/26* (2013.01)
*G10L 19/02* (2013.01)

(52) U.S. Cl.
CPC ..... *G10L 19/26* (2013.01); *G10L 19/02* (2013.01)

(58) Field of Classification Search
CPC ..... G10L 19/02; G10L 19/22; G10L 19/26
USPC ..... 704/205, 226, 228
See application file for complete search history.

(56) References Cited

U.S. PATENT DOCUMENTS 5,495,555 A * 2/1996 Swaminathan ..... 704/207
5,884,010 A * 3/1999 Chen et al. ..... 704/228
6,584,441 B1 * 6/2003 Ojala et al. ..... 704/500
7,353,169 B1 * 4/2008 Goodwin et al. ..... 704/224
7,590,523 B2 * 9/2009 Gao ..... 704/200.1
8,315,853 B2 * 11/2012 Kim et al. ..... 704/200
2003/0009325 A1 * 1/2003 Kirchherr et al. ..... 704/211
2004/0002856 A1 * 1/2004 Bhaskar et al. ..... 704/219
2005/0075870 A1 * 4/2005 Chamberlain ..... 704/226
2006/0020450 A1 * 1/2006 Miseki ..... 704/219
2006/0116874 A1 * 6/2006 Samuelsson et al. ..... 704/228
2007/0219785 A1 * 9/2007 Gao ..... 704/200.1
2008/0027733 A1 * 1/2008 Oshikiri et al. ..... 704/500
2008/0195383 A1 * 8/2008 Shlomot et al. ..... 704/205
2009/0150143 A1 * 6/2009 Kim et al. ..... 704/203
2009/0234644 A1 * 9/2009 Reznik et al. ..... 704/203
2009/0326931 A1 * 12/2009 Ragot ..... G10L 19/24 704/220
2010/0063806 A1 * 3/2010 Gao ..... 704/207
2010/0063808 A1 * 3/2010 Gao ..... 704/226
(Continued)

OTHER PUBLICATIONS

Geiser, Bernd, et al. "Candidate proposal for ITU-T super-wideband speech and audio coding." Acoustics, Speech and Signal Processing, 2009. ICASSP 2009. IEEE International Conference on. IEEE, Apr. 2009, pp. 4121-4124.*
(Continued)

*Primary Examiner* — James Wozniak
(74) *Attorney, Agent, or Firm* — Sage Patent Group

(57) ABSTRACT

Method and decoder for processing of audio signals. The method and decoder relate to deriving a processed vector $\hat{d}$ by applying a post-filter directly on a vector d comprising quantized MDCT domain coefficients of a time segment of an audio signal. The post-filter is configured to have a transfer function H which is a compressed version of the envelope of the vector d. A signal waveform is reconstructed by performing an inverse MDCT transform on the processed vector $\hat{d}$.

21 Claims, 6 Drawing Sheets

(56) References Cited

U.S. PATENT DOCUMENTS

| | | | | |
|---|---|---|---|---|
| 2010/0063827 | A1* | 3/2010 | Gao | 704/500 |
| 2010/0070270 | A1* | 3/2010 | Gao | 704/207 |
| 2010/0286805 | A1* | 11/2010 | Gao | G10L 19/0017 700/94 |
| 2011/0002266 | A1* | 1/2011 | Gao | 370/328 |
| 2011/0282656 | A1* | 11/2011 | Grancharov et al. | 704/203 |

OTHER PUBLICATIONS

European Search Report Corresponding to European Application No. 11780883.2; dated Sep. 3, 2013; 3 Pages.

Kabal P. et al., "Adaptive Postfiltering for Enhancement of Noisy Speech in the Frequency Domain", *Signal Image and Video Processing, Singapore, Proceedings of the International Symposium on Circuits and Systems*, Jun. 11-14, 1991, vol. 1, p. 312-315.

International Search Report Corresponding to International Application No. PCT/SE2011/050518; dated Nov. 10, 2011; 10 pages.

* cited by examiner

METHODS AND APPARATUS FOR POST-FILTERING MDCT DOMAIN AUDIO COEFFICIENTS IN A DECODER

CROSS-REFERENCE TO RELATED APPLICATIONS

This application claims the benefits under 35 U.S.C §119(e) of U.S. Provisional Patent Application No. 61/333,498 filed May 11, 2010 and 35 U.S.C §365 of International Patent Application No. PCT/SE2011/050518 filed Apr. 28, 2011, the disclosures of which is hereby incorporated by reference herein in its entirety.

TECHNICAL FIELD

The invention relates to processing of audio signals, in particular to a method and an arrangement for improving perceptual quality by post-filtering.

BACKGROUND

Audio coding at low or moderate bitrates is widely used to reduce network load. However, bit rate reduction inevitably leads to quality decrease due to an increased amount of quantization noise. One way to minimize the perceptual impact of quantization noise is to use a post-filter. A post-filter operates at the decoder and affects reconstructed signal parameters, or, directly the signal waveform. The use of a post-filter aims at attenuating spectrum valleys, where quantization noise is most audible, and thereby achieve improved perceptual quality.

Both pitch and formant post-filters are used for quality enhancement in so-called ACELP (Algebraic Code Excited Linear Prediction) speech codecs. These filters operate in the time-domain and are typically based on the speech model used in the ACELP codec [1]. However, this family of post-filters is not well suited for use with transform audio codecs, such as e.g. G.719 [2].

Thus, there is a need for improving the perceptual quality of audio signals which have been subjected to transform audio coding.

SUMMARY

It would be desirable to achieve improved perceptual quality of audio signals which have been subjected to transform audio coding. It is an object of the invention to improve the perceptual quality of an audio signal which has been subjected to transform audio coding. Further, it is an object of the invention to provide a method and an arrangement for post-filtering of an audio signal which has been subjected to transform audio coding. These objects may be met by a method and an apparatus according to the attached independent claims. Embodiments are set forth in the dependent claims.

According to a first aspect, a method is provided in a decoder. The method involves obtaining a vector d, comprising quantized MDCT domain coefficients of a time segment of an audio signal. Further, a processed vector $\hat{d}$ is derived by applying a post-filter directly on the vector d. The post-filter is configured to have a transfer function H which is a compressed version of the envelope of the vector d. Further, a signal waveform is derived by performing an inverse MDCT transform on the processed vector $\hat{d}$.

According to a second aspect, a decoder is provided. The decoder comprises a functional unit adapted to obtain a vector d, which comprises quantized MDCT domain coefficients of a time segment of an audio signal. The decoder further comprises a functional unit, adapted to derive a processed vector $\hat{d}$ by applying a post-filter directly on the vector d. The post-filter is configured to have a transfer function H which is a compressed version of the envelope of the vector d. The decoder further comprises a functional unit adapted to derive a signal waveform by performing an inverse MDCT transform on the processed vector $\hat{d}$ The above method and arrangement involving an MDCT post-filter may be used for improving the quality of moderate and low-bitrate audio coding systems. When the post-filter is used in an MDCT codec, the additional complexity is very low, as the post-filter operates directly on the MDCT vector.

The above method and arrangement may be implemented in different embodiments. In some embodiments, the denominator of the transfer function H is configured to comprise a maximum of the vector $|d|$, which may be an estimate obtained by recursive maximum tracking over the vector $|d|$. In some embodiments, the transfer function H is configured to comprise an emphasis component, configured to control the post-filter aggressiveness over the MDCT spectrum. The emphasis component could be e.g. frequency dependent or constant. Further, the energy of the processed vector $\hat{d}$ may be normalized to the energy of the vector d.

In some embodiments, the processed vector $\hat{d}$ is derived only when the audio signal time segment is determined to comprise speech. Further, the transfer function H could be limited or suppressed when the audio signal time segment is determined to mainly consist of one or more of e.g. unvoiced speech, background noise and music.

The embodiments above have mainly been described in terms of a method. However, the description above is also intended to embrace embodiments of the decoder, adapted to enable the performance of the above described features. The different features of the exemplary embodiments above may be combined in different ways according to need, requirements or preference.

BRIEF DESCRIPTION OF THE DRAWINGS

The invention will now be described in more detail by means of exemplifying embodiments and with reference to the accompanying drawings, in which.

DETAILED DESCRIPTION

Briefly described, a decoder comprising a post-filter is provided, which post-filter is designed to work with MDCT (Modified Discrete Cosine Transform) type transform codecs, such as e.g., G.719 [2]. The suggested post-filter operates directly on the MDCT domain, and does not require additional transformation of the audio signal to DFT or time domain, which keeps the computational complexity low. The quality improvement due to the post-filter is confirmed in listening tests.

The concept of transform coding is to convert, or transform, an audio signal to be encoded into the frequency domain, and then quantize the frequency coefficients, which are then stored or conveyed to a decoder. The decoder uses the received (quantized) frequency coefficients to reconstruct the audio signal waveform, by applying the inverse frequency transform. The motivation behind this coding scheme is that frequency domain coefficients can be more efficiently quantized than time domain coefficients.

In an MDCT type transform encoder, a block signal waveform x(n) is transformed into an MDCT vector d*(k). The length, "L", of such a vector corresponds to 20-40 ms of speech segments. The MDCT transform can be defined as:

$$d*(k)=\sum_{n=0}^{L-1}\sin\left[\left(n+\frac{1}{2}\right)\frac{\pi}{2}\right]\cos\left[\left(n+\frac{1}{2}\right)\left(k+\frac{1}{2}\right)\frac{\pi}{L}\right]x(n)$$

The MDCT coefficients are quantized, thus forming a quantized MDCT coefficient vector d(k)=Q(d*(k)), which is to be decoded by an MDCT decoder.

The post-filter may be applied directly on the received vector d(k) at the decoder, and thus derive the post-filtered vector $\hat{d}$ as $$\hat{d}(k)=H(k)d(k)$$

The transfer function, or filter function, H(k), is a compressed version of the envelope of the MDCT spectrum:

$$H(k)=\left(\frac{\mathrm{abs}[d(k)]}{\max[\mathrm{abs}(d)]}\right)^{a(k)} \quad (1)$$

Figure 1:
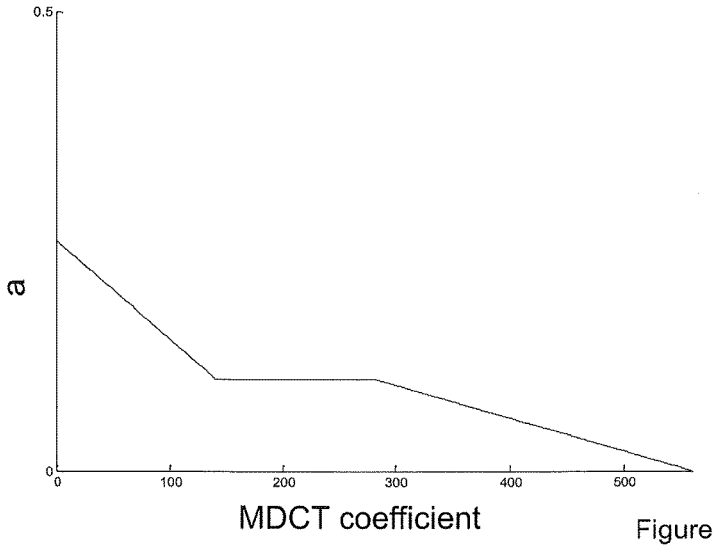
FIG. 1 shows a diagram of an exemplary emphasis factor a(k), which decreases (to limit the effect of the post-filter) towards higher frequencies, according to an exemplifying embodiment.
Figure 2:
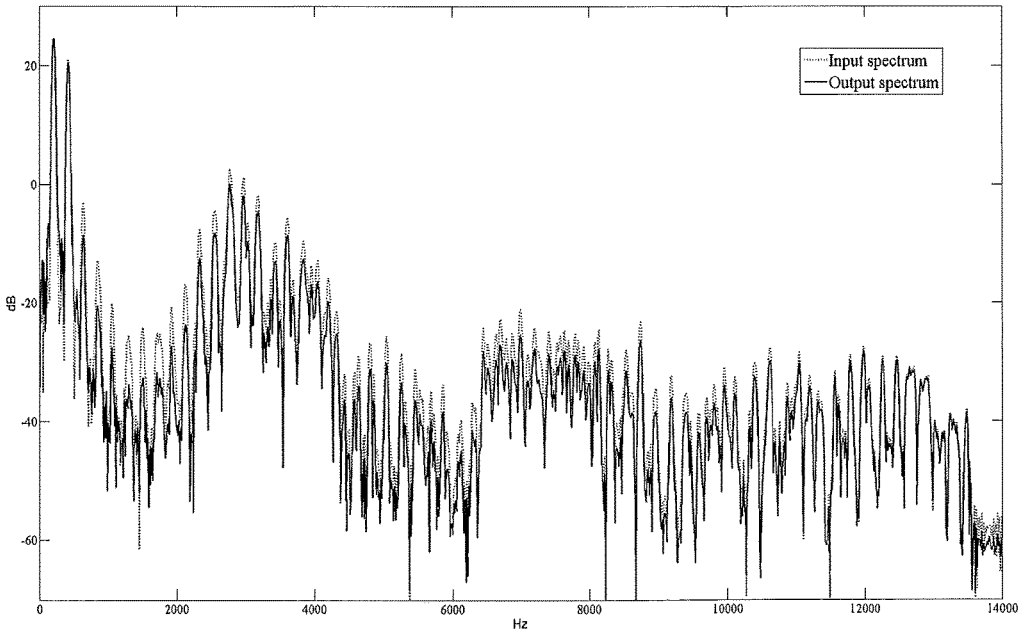
FIG. 2 shows a diagram illustrating the effect of the post-filter on a signal spectrum, where the dotted thin line represents the signal spectrum before the post-filter, and the solid line represents the signal spectrum after the post-filter, according to an exemplifying embodiment.

The parameter a(k) may be set to control the post-filter "aggressiveness", or "amount of emphasis" over the MDCT spectrum. FIG. 1 shows a diagram of an example of how a(k) may be configured as a frequency dependent vector. However, a(k) could also be constant over the spectrum. The effect of the post-filter on the signal spectrum is illustrated in FIG. 2. As can be seen in FIG. 2, the spectrum valleys are deepened after post-filtering.

The energy of the post-filter output may preferably be normalized to the energy of the post-filter input:

$$\hat{d}_{(normalized)}(k)=\frac{std(d)}{std(\hat{d})}\hat{d}(k)$$

Here std(d) is the standard deviation of the vector d, which comprises quantized MDCT coefficients, before the post-filtering operation; and std($\hat{d}$) is the standard deviation of the processed vector $\hat{d}$, i.e. of the vector d after the post-filtering operation.

Further, the audible quantization noise due to coding is most audible in voiced speech, as compared to e.g. music. Thus, for example, the use of the suggested post-filter is more efficient for decreasing audible quantization noise in speech signals, rather than in music signals. Thus, when suitable, the post-filter could be switched off, or suppressed, in frames or frame segments for which the post-filter is considered to be less effective. For example, the post-filter could be switched off, or suppressed, in frames or frame segments, which are determined to mainly consist of unvoiced speech, background noise, and/or music. The post-filter could be used in combination with e.g. a speech-music discriminator, and/or a background noise estimation module, for determining the contents of a frame. However, it should be noted that the post-filter does not cause any degradation in e.g. unvoiced segments.

Figure 3:
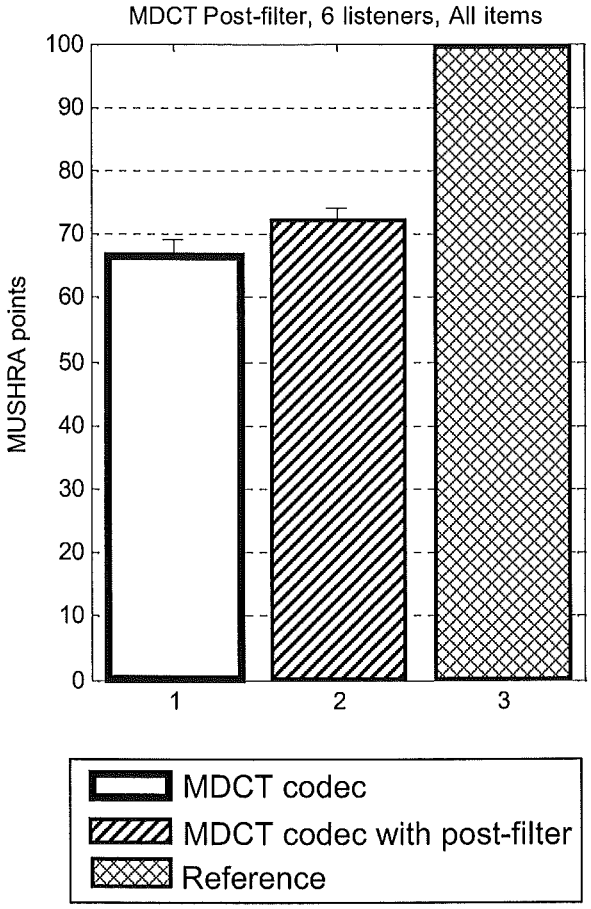
FIG. 3 shows the result of a MUSHRA listening test comparing an MDCT audio codec with and without post-filter, according to an exemplifying embodiment.

The perceived effect of the use of the post-filter has been tested in a so-called MUSHRA test, of which the result is illustrated in FIG. 3. "MUSHRA" stands for MUltiple Stimuli with Hidden Reference and Anchor, and is a methodology for subjective evaluation of audio quality, typically used for evaluating the perceived quality of the output from lossy audio compression algorithms. The more MUSHURA points given to a signal, the better perceived audio quality. In FIG. 1, the first bar (#1) represents an MDCT decoded signal where no post-filter was used in the decoding process. The second bar (#2) represents an MDCT decoded signal, where the suggested post-filter was used in the decoding process. The third bar (#3) represents an original speech signal, which has not been subjected to coding, and is thus given the maximal amount of points/score. As can be seen in FIG. 3, the use of the post filter gives a significant increase of the perceived audio quality.

Figure 4:
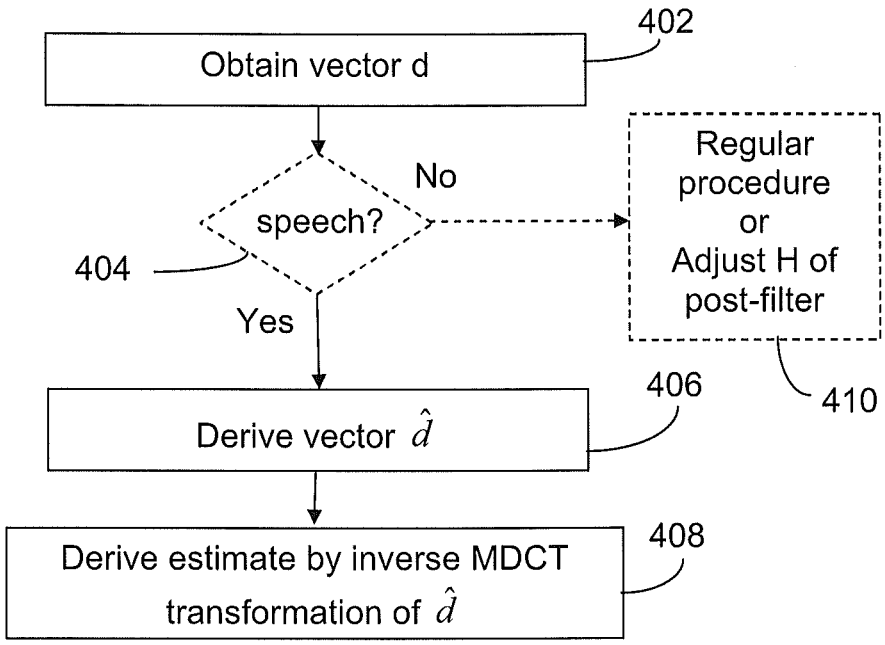
FIG. 4 is a flow chart illustrating the actions of a procedure performed in a decoder, according to an exemplifying embodiment.

Exemplifying Procedure FIG. 4

An exemplifying embodiment of the procedure of decoding an MDCT-encoded audio signal will now be described with reference to FIG. 4. The procedure could be performed in an audio handling entity, such as e.g. a node in a teleconference system and/or a node or terminal in a wireless or wired communication system, a node involved in audio broadcasting, or an entity or device used in music production.

A vector d, comprising quantized MDCT coefficients of a time segment of an audio signal, is obtained in an action 402. The coefficient vector is assumed to be produced by an MDCT encoder, and is assumed to be received from another node or entity, or, to be retrieved e.g. from a memory.

A processed vector $\hat{d}$ is derived in an action 406, by applying a post-filter directly on the vector d, which post-filter is configured to have a transfer function H which is a compressed version of the envelope of the vector d. Further, a reconstructed signal waveform is derived in an action 408 by performing an inverse MDCT transform on the processed vector $\hat{d}$.

The denominator of the transfer function H may be configured to comprise a maximum of the vector d. Said maximum could be the largest coefficient (absolute value) of |d|, or e.g. an estimate obtained by recursive maximum tracking over the vector |d|.

The transfer function H may further be configured to comprise an emphasis component, configured to control the post-filter aggressiveness, or amount of emphasis, over the MDCT spectrum. This component is denoted "a" in FIG. 1 and equation 1. The component "a" could e.g. be a frequency dependent vector, or a constant.

The energy of the output of the post-filter, i.e. the processed vector $\hat{d}$, may be normalized to the energy of the input to the post-filter, i.e. to the energy of the vector d. Further, the contents of the audio signal segment could be determined, and the post-filter could be applied in accordance with said contents. For example, the processed vector $\hat{d}$ could be derived e.g. only when the audio signal time segment is determined to comprise speech. Further, the transfer function H of the post-filter could be limited or suppressed when the audio signal time segment is determined to mainly consist of e.g. unvoiced speech, background noise, or music. These conditional actions are illustrated as the actions 404 and 410 in FIG. 4. The contents of the audio signal segment could be determined based on the vector d, or, it could be determined in the encoder, based on the audio signal waveform, and information related to the contents could then be signaled in a suitable way from the encoder to the decoder.

Figure 5:
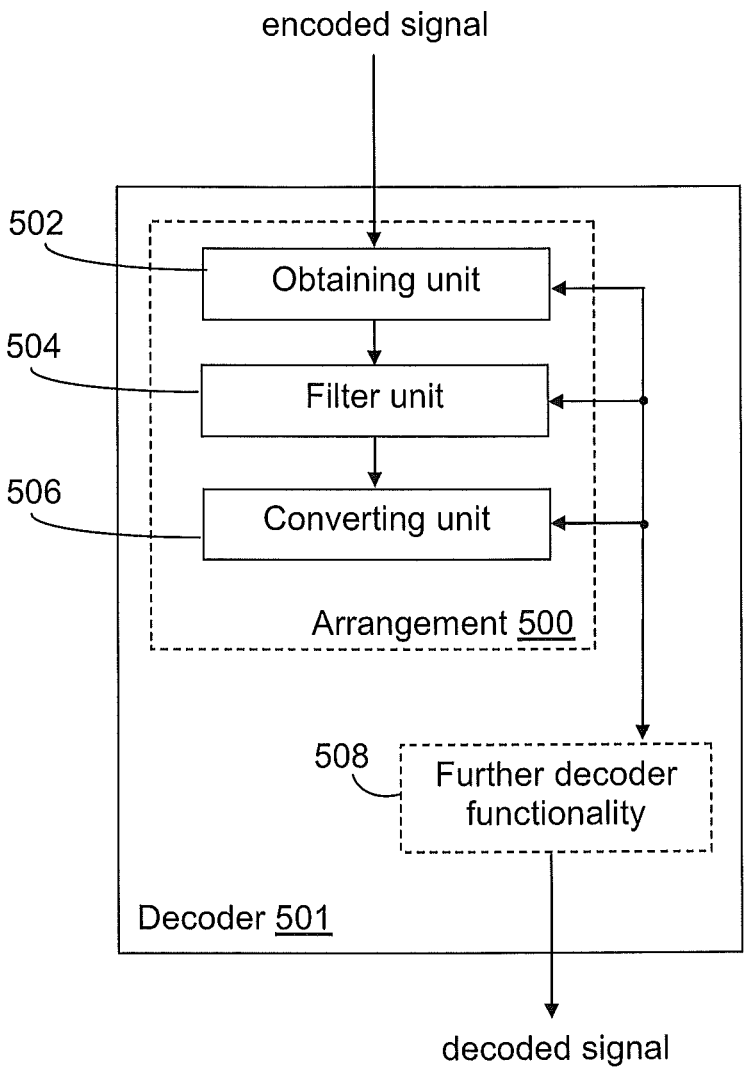
FIGS. 5-7 are block diagrams illustrating a respective arrangement in a decoder and an audio handling entity, according to exemplifying embodiments.
Figure 6:
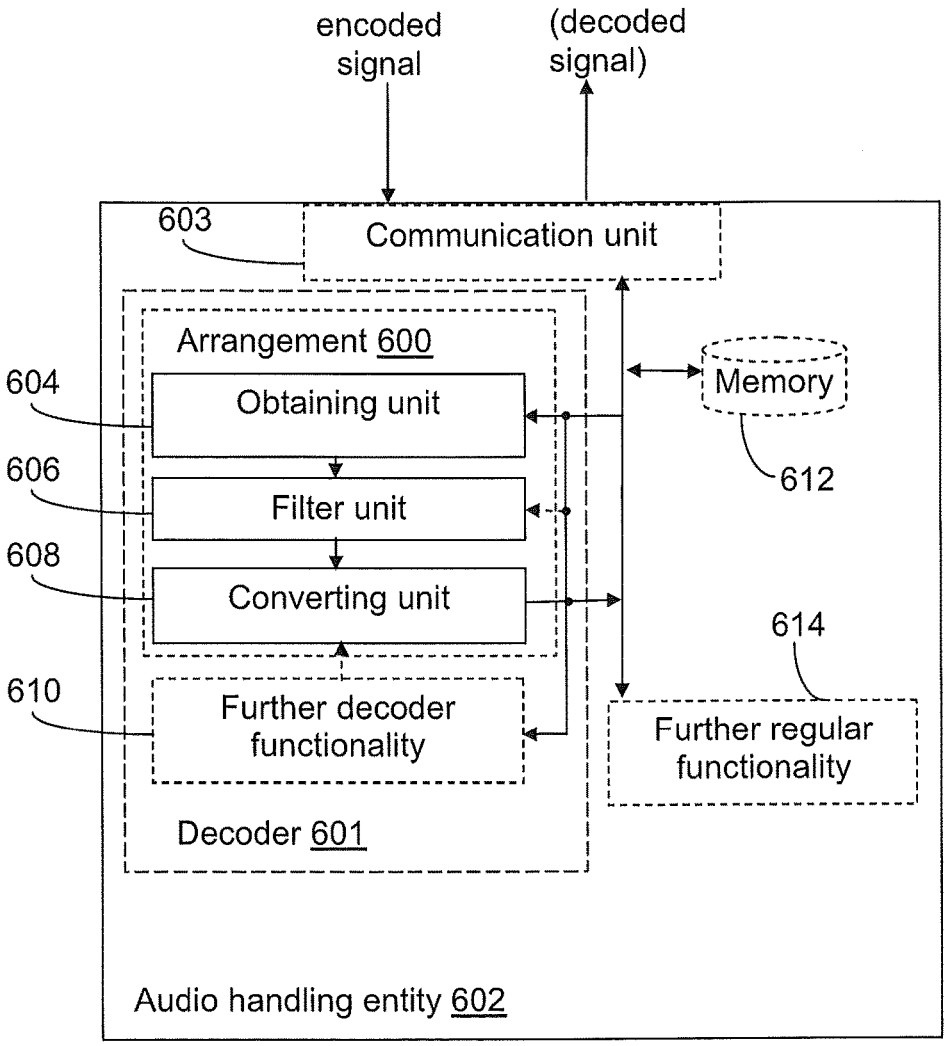

Exemplifying Arrangements, FIGS. 5 and 6

Below, an exemplifying decoder 501, adapted to enable the performance of the above described procedure related to decoding of a signal, will be described with reference to FIG. 5.

The decoder 501 comprises an obtaining unit 502, which is adapted to obtain a vector d, comprising quantized MDCT domain coefficients of a time segment of an audio signal. The vector d could e.g. be received from another node, or be retrieved e.g. from a memory. The decoder further comprises a filter unit 504, which is adapted to derive a processed vector $\hat{d}$, by applying a post-filter directly on the obtained vector d. The post-filter should be configured to have a transfer function H, which is a compressed version of the envelope of the obtained vector d. Further, the decoder comprises a converting unit 506 configured to derive a signal waveform, i.e. an estimate or reconstruction of the signal waveform comprised in the audio signal time segment, by performing an inverse MDCT transform on the processed vector $\hat{d}$.

The arrangement 500 is suitable for use in a decoder, and could be implemented e.g. by one or more of: a processor or a micro processor and adequate software, a Programmable Logic Device (PLD) or other electronic component(s).

The decoder may further comprise other regular functional units 508, such as one or more storage units.

FIG. 6 illustrates a decoder 601 similar to 501, illustrated in FIG. 5. The decoder 601 is illustrated as being located or comprised in an audio handling entity 602 in a communication system. The audio, handling entity could be e.g. a node or terminal in a wireless or wired communication system, a node or terminal in a teleconference system, and/or a node involved in audio broadcasting. The audio handling entity 602 and the decoder 601 is further illustrated as to communicate with other entities via a communication unit 603, which may be considered to comprise conventional means for wireless and/or wired communication. The arrangement 600 and units 604-610 correspond to the arrangement 500 and units 502-508 in FIG. 5. The audio handling entity 602 could further comprise additional regular functional units 614 and one or more storage units 612.

Figure 7:
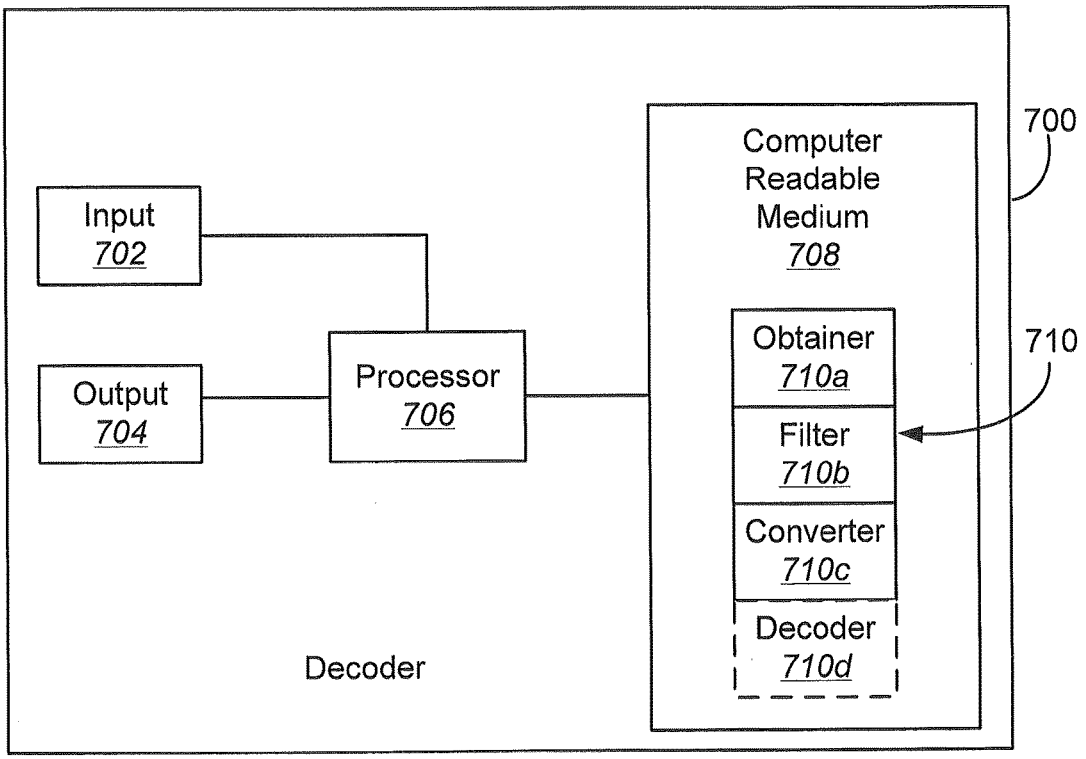

Exemplifying Arrangement, FIG. 7

FIG. 7 illustrates an implementation of a decoder or arrangement 700 suitable for use in an audio handling entity, where a computer program 710 is carried by a computer program product 708, connected to a processor 706. The computer program product 708 comprises a computer readable medium on which the computer program 710 is stored. The computer program 710 may be configured as a computer program code structured in computer program modules. Hence, in the example embodiment described, the code means in the computer program 710 comprises an obtaining module 710*a* for obtaining a vector d comprising quantized MDCT domain coefficients of a time segment of an audio signal. The computer program further comprises a filter module 710*b* for deriving a processed vector $\hat{d}$. The computer program 710 further comprises a converting module 710*c* for deriving an estimate of the audio signal time segment. The computer program may comprise further modules, e.g. 710*d* for providing other decoder functionality.

The modules 710*a-d* could essentially perform the actions of the flow illustrated in FIG. 4, to emulate the decoder illustrated in FIG. 5. In other words, when the different modules 710*a-d* are executed in the processing unit 706, they correspond to the respective functionality of units 502-508 of FIG. 5. For example, the computer program product may be a flash memory, a RAM (Random-access memory) ROM (Read-Only Memory) or an EEPROM (Electrically Erasable Programmable ROM), and the computer program modules 710*a-d* could in alternative embodiments be distributed on different computer program products in the form of memories within the decoder 601 and/or the audio handling entity 602. The units 702 and 704 connected to the processor represent communication units e.g. input and output. The unit 702 and the unit 704 may be arranged as an integrated entity.

Although the code means in the embodiment disclosed above in conjunction with FIG. 7 are implemented as computer program modules which when executed in the processing unit causes the decoder and/or audio handling entity to perform the actions described above in the conjunction with figures mentioned above, at least one of the code means may in alternative embodiments be implemented at least partly as hardware circuits.

It is to be noted that the choice of interacting units or modules, as well as the naming of the units are only for exemplifying purpose, and network nodes suitable to execute any of the methods described above may be configured in a plurality of alternative ways in order to be able to execute the suggested process actions.

It should also be noted that the units or modules described in this disclosure are to be regarded as logical entities and not with necessity as separate physical entities.

ABBREVIATIONS

ACELP—Algebraic Code Excited Linear Prediction
MDCT—Modified Discrete Cosine Transform
DFT—Discrete Fourier Transform
MUSHRA—MUltiple Stimuli with Hidden Reference and Anchor

The invention claimed is:

1. A method of operating a decoder comprising:

obtaining a vector d(k) comprising quantized Modified Discrete Cosine Transform (MDCT) domain coefficients of a time segment of an audio signal;

deriving a processed vector $\hat{d}(k)$ by applying a post-filter directly on the vector d(k), the post-filter being configured to have a transfer function H(k), $$H(k)=\{(\mathrm{abs}[d(k)])/(\max[\mathrm{abs}(d)])\}^{a(k)},$$

which is a compressed version of an envelope of the vector d(k), where k goes from 1 to the number of MDCT domain coefficients of the time segment of the audio signal, where max[abs(d)] is a maximum of an absolute value of the vector d(k), and a(k) is an emphasis component configured to control a post-filter aggressiveness over the MDCT spectrum; and deriving a signal waveform by performing an inverse MDCT transform on the processed vector $\hat{d}(k)$.

2. A method according to claim 1, where the maximum of the absolute value of the vector d(k) is a coefficient of |d| having a largest magnitude.

3. A method according to claim 1, wherein energy of the processed vector $\hat{d}(k)$ is normalized to energy of the vector d(k).

4. A method according to claim 1, wherein the processed vector $\hat{d}(k)$ is derived only when the time segment of the audio signal is determined to comprise speech.

5. A method according to claim 1, wherein the transfer function H(k) is limited when the time segment of the audio signal is determined to comprise at least one of unvoiced speech, background noise, and music.

6. A method according to claim 1, the maximum of the absolute value of the vector d(k) is an estimate of a maximum of the vector |d| obtained by recursive maximum tracking over the vector |d|.

7. A method according to claim 1, wherein the emphasis component a(k) is frequency dependent.

8. A decoder comprising:

a processor implementing:

a filter configured to derive a processed vector $\hat{d}(k)$ by applying a post-filter directly on a vector d(k), wherein the vector d(k) comprises quantized Modified Discrete Cosine Transform (MDCT) domain coefficients of a time segment of an audio signal, the post-filter being configured to have a transfer function H(k), $$H(k)=\{(\mathrm{abs}[d(k)])/(\max[\mathrm{abs}(d)])\}^{a(k)},$$

which is a compressed version of an envelope of the vector d(k), where k goes from 1 to the number of MDCT domain coefficients of the time segment of the audio signal, where max[abs(d)] is a maximum of an absolute value of the vector d(k), and a(k) is an emphasis component configured to control a post-filter aggressiveness over the MDCT spectrum, and a converter configured to derive a signal waveform by performing an inverse MDCT transform on the processed vector $\hat{d}(k)$.

9. A decoder according to claim 8, where the maximum of the absolute value of the vector d(k) is a coefficient of |d| having a largest magnitude.

10. A decoder according to claim 8, wherein the filter is further configured to normalize energy of the processed vector $\hat{d}(k)$ to energy of the vector d(k).

11. A decoder according to claim 8, wherein the filter is further configured to derive $\hat{d}(k)$ only when the time segment of the audio signal is determined to comprise speech.

12. A decoder according to claim 8, wherein the filter is further configured to limit the transfer function H(k) when the time segment of the audio signal is determined to comprise at least one of unvoiced speech, background noise, and music.

13. A decoder according to claim 8, wherein the maximum of the absolute value of the vector d(k) is an estimate of a maximum of the vector |d| obtained by recursive maximum tracking over the vector |d|.

14. A decoder according to claim 8, wherein the emphasis component a(k) is frequency dependent.

15. An audio handling entity comprising:

memory including computer program modules; and a decoder coupled with the memory, the decoder being configured to execute the computer program modules of the memory to, obtain a vector d(k) comprising quantized Modified Discrete Cosine Transform (MDCT) domain coefficients of a time segment of an audio signal, derive a processed vector $\hat{d}(k)$ by applying a post-filter directly on the vector d(k), the post-filter being configured to have a transfer function H(k), $$H(k)=\{(\mathrm{abs}[d(k)])/(\max[\mathrm{abs}(d)])\}^{a(k)},$$

which is a compressed version of an envelope of the vector d(k), where k goes from 1 to the number of MDCT domain coefficients of the time segment of the audio signal, where max[abs(d)] is a maximum of an absolute value of the vector d(k), and a(k) is an emphasis component configured to control a post-filter aggressiveness over the MDCT spectrum, and derive a signal waveform by performing an inverse MDCT transform on the processed vector $\hat{d}(k)$.

16. An audio handling entity according to claim 15, wherein the maximum of the absolute value of the vector d(k) is an estimate of a maximum of the vector |d| obtained by recursive maximum tracking over the vector |d|.

17. An audio handling entity according to claim 15, wherein the emphasis component a(k) is frequency dependent.

18. An audio handling entity according to claim 15, where the maximum of the absolute value of the vector d(k) is a coefficient of |d| having a largest magnitude.

19. An audio handling entity according to claim 15, wherein energy of the processed vector $\hat{d}(k)$ is normalized to energy of the vector d(k).

20. An audio handling entity according to claim 15, wherein the processed vector $\hat{d}(k)$ is derived only when the time segment of the audio signal is determined to comprise speech.

21. An audio handling entity according to claim 15, wherein the transfer function H(k) is limited when the time segment of the audio signal is determined to comprise at least one of unvoiced speech, background noise, and music.

* * * * *